US006324955B1

(12) United States Patent
Andersson et al.

(10) Patent No.: US 6,324,955 B1
(45) Date of Patent: Dec. 4, 2001

(54) EXPLOSIVE COUNTERMEASURE DEVICE

(75) Inventors: Norman H. Andersson, Alta Loma; Emery S. Almasy, Colton, both of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 07/871,868

(22) Filed: Apr. 20, 1992

(51) Int. Cl.[7] ..... B64D 1/04; F42B 4/00; F42B 4/26

(52) U.S. Cl. ..... 89/1.11; 102/335; 102/346; 89/1.51

(58) Field of Search ..... 89/1.11, 1.51; 102/335, 336, 346; 431/359, 361, 362

(56) References Cited

U.S. PATENT DOCUMENTS

| | | | | |
|---|---|---|---|---|
| 1,936,595 | * | 11/1933 | Goddard | 89/1.51 |
| 2,764,094 | * | 9/1956 | Messerly et al. | 102/336 |
| 3,224,236 | * | 12/1965 | De Ment | 431/362 |
| 3,514,605 | | 5/1970 | Cronk et al. | 250/85 |
| 3,680,431 | | 8/1972 | Papp | 89/7 |
| 3,837,281 | | 9/1974 | Shaffer et al. | 102/336 |
| 3,851,587 | | 12/1974 | Alchorn et al. | 102/275.8 |
| 3,992,628 | | 11/1976 | Karney | 250/338 |
| 4,019,421 | * | 4/1977 | Strom | 89/1.51 |
| 4,171,669 | | 10/1979 | Allen | 102/357 |
| 4,286,498 | | 9/1981 | Block et al. | 86/1.1 |
| 4,392,412 | | 7/1983 | Schmidt et al. | 89/14.4 |
| 4,697,521 | | 10/1987 | Espagnacq et al. | 102/334 |
| 4,719,857 | | 1/1988 | Spring | 102/335 |

FOREIGN PATENT DOCUMENTS

| | | | | |
|---|---|---|---|---|
| 1646309 | * | 11/1971 | (DE) | 102/336 |

OTHER PUBLICATIONS

Heflin, W.A., The United States Air Force Dictionary, "flare", 1957, p. 208.*

Schleher, D.C, Introduction to Electronic Warfare, "3.4 Expendable Electronic Countermeasures", 1986, pp. 178–183.*

Skolnik, M.I., Introduction to Radar Systems, "12.10. ECM and ECCM", 1962, pp. 559–565.*

* cited by examiner

*Primary Examiner*—Charles T. Jordan
*Assistant Examiner*—Kimberly S Smith
(74) *Attorney, Agent, or Firm*—Leonard A. Alkov; Colin M. Raufer; Glenn H. Lenzen, Jr.

(57) ABSTRACT

An explosive countermeasure device is designed to negate an electro-optical seeker system of a missile at least temporarily so that it loses lock on a target aircraft. The device has a central explosive charge with a detonator and a container surrounding the charge for holding a noble gas under pressure. When the charge is detonated, the resultant explosive shock wave will heat the gas to a temperature sufficient for it to emit a short, intense flash of light before the container disintegrates, blinding the electro-optical seeker system at least temporarily.

3 Claims, 2 Drawing Sheets

EXPLOSIVE COUNTERMEASURE DEVICE

BACKGROUND OF THE INVENTION

The present invention relates generally to decoys or countermeasure devices for negating or confusing seeker or tracker devices of homing missiles so that they loose lock on the target, at least temporarily.

Anti-aircraft missiles have electro-optical seeker devices for homing in on the infrared or other wavelength radiation emitted from an aircraft engine tailpipe. Conventional flares are often used in attempting to decoy the seeker devices so that they lose their lock on the target, the aircraft being flown out of line of sight with the missile under the cover of the decoy flare. In conventional pyrotechnic flares, a mixture of chemicals contained in a cartridge is ignited after expelling the flare from the aircraft, forming an infrared source for decoying a hostile infrared seeking missile. The duration of such flares is from milliseconds to seconds in length. Such devices are quite well known and understood, and missile designers have developed means for enabling current missiles to ignore most of the existing flare countermeasures.

SUMMARY OF THE INVENTION

It is an object of the present invention to provide a new and improved countermeasure device for negating infrared or multi-color electro-optical seeker systems.

According to the present invention, a countermeasure device is provided, which comprises an explosive charge and a container surrounding the charge for containing a noble gas. When the charge is detonated in the confined atmosphere of a monatomic gas such as argon or xenon, the propagation of the resultant shock wave through the gas causes adiabatic heating and compression of the gas. This heats the gas to very high temperatures and causes it to generate an intense flash of light containing virtually all wavelengths, effectively blinding the optical seeker system of any missile tracking a target from which the device is dispensed. The device produces light at an intensity several orders of magnitude greater than that of a conventional flare. The device produces a short pulse of electromagnetic energy having a duration of the order of tens of microseconds, in a broad band of wavelengths from ultraviolet to infrared. This will at least temporarily blind the seeker, causing it to loose lock on the targeted aircraft heat source.

The decoy countermeasure is designed to fit into standard aircraft flare dispensers, in other words the shape and dimensions of the device are equivalent to those of standard decoy flares. In a preferred embodiment of the invention, the container comprises an expandable balloon surrounding the charge and an enclosed supply of noble gas under pressure is also enclosed in the container. The gas supply is released into the balloon prior to detonation of the charge, so that the gas will expand the balloon and surround the charge. Reflective strips of material such as Mylar may be held on the outside of the balloon prior to inflation. As the balloon inflates, the strips will be dispersed into a cloud around the device. After detonation, light will be transmitted towards the target both directly from the heated gas and indirectly by reflection from the strips.

The countermeasure device of this invention produces light from an explosively driven light source, rather than by burning chemicals as in conventional flares, and will be more effective than conventional flares due to the broad band of wavelengths covered, the high intensity, and the relatively short duration of the pulse, giving insufficient time for the seeker itself to institute any countermeasures against the decoy device.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
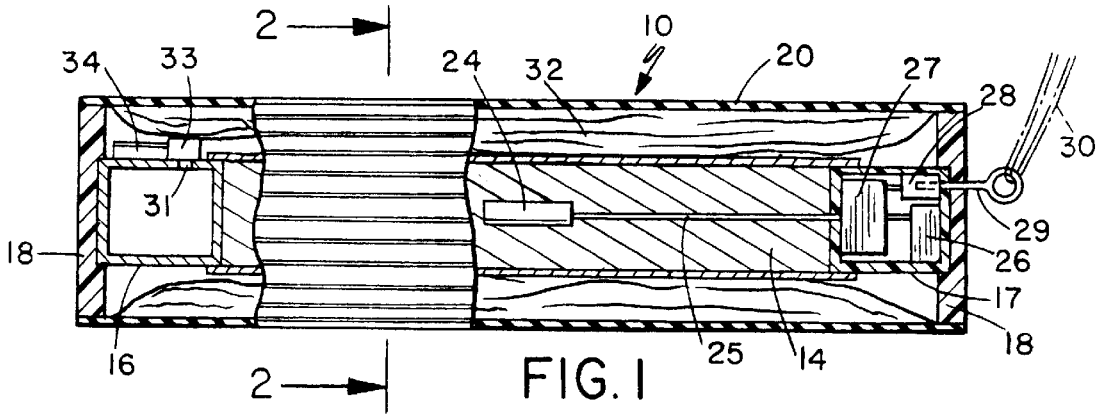
FIG. 1 is a side elevation view, with portions cut away of a countermeasure device according to a preferred embodiment of the invention in closed configuration ready for launch.
Figure 2:
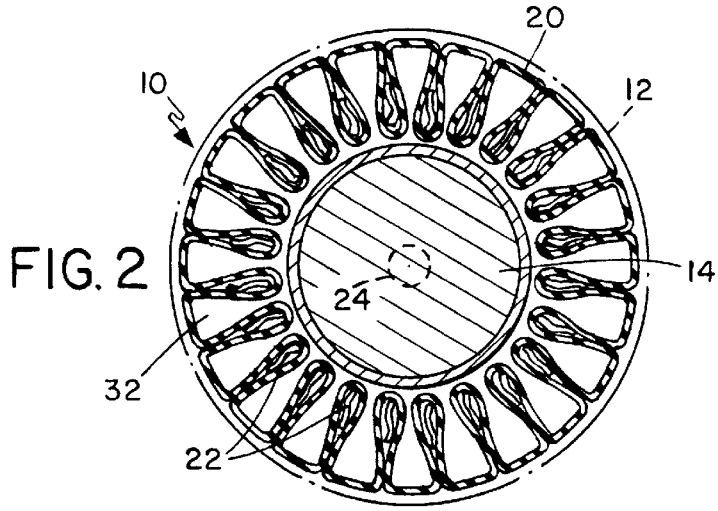
FIG. 2 is an enlarged sectional view taken on line 2—2 of FIG. 1.

FIGS. 1 and 2 illustrate a countermeasure 10 for preventing or impeding a missile seeker system from tracking and homing in on a target. The device is illustrated in FIGS. 1 and 2 in its unexpanded or closed condition prior to launch from a standard aircraft flare dispenser 12, as indicated in dotted outline in FIG. 2. The device basically comprises a central cylindrical explosive charge or billet 14 having at least one bottle 16 of matching diameter secured to one end. Gas bottles 16 may be secured at both ends of the charge, but in the illustrated embodiment a housing 17 for the actuating circuitry is secured at the opposite end of the charge, as illustrated in FIG. 1. Gas bottle 16 contains a noble or monatomic gas such as argon or xenon under pressure. End pieces 18 are secured to the outer, free end of the gas bottle 16 and electronics housing 17. The end pieces will be made of a clear material such as plastic or quartz to allow transmission of light.

A balloon 20 of transparent, flexible material is secured between the two end pieces to form a sleeve surrounding the charge 14 in the collapsed, uninflated condition of FIGS. 1 and 2. Strips 22 of reflective material such as Mylar are held between the folds of the collapsed balloon on the outside of the device, as best illustrated in FIG. 2.

Figure 4:
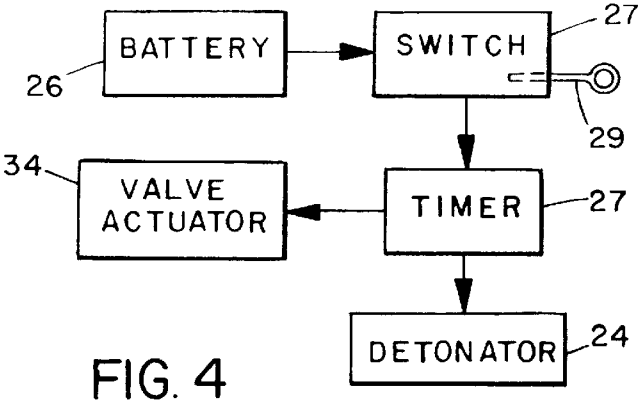
FIG. 4 is a diagram of the actuating system.

An electronically actuated detonator 24 is provided in the center of the explosive charge 14. Detonator 24 is connected via lead 25 to the actuating circuitry in housing 17. The circuitry includes a battery 26, a timer circuit 27, and a switch 28, as illustrated in FIGS. 1 and 4. The switch is connected via arming pin 29 to a tether 30 connecting the device to the aircraft, in a similar arrangement to a standard flare.

Gas bottle 16 has an outlet 31 for communicating with the interior 32 of balloon 20 surrounding the charge. The outlet is normally closed via valve 33 which is connected to valve actuator 34, such as a solenoid. Actuator 34 is connected to the timer 27, as illustrated in FIG. 4.

The detonator 24 may be a single point detonator in the middle of charge 14, as illustrated, or may be a line detonator extending the length of the charge for simultaneous detonation at multiple points along the charge. The timer circuitry is arranged so that the valve 33 is opened prior to detonation of the charge 14, in a manner which will be understood by one skilled in the explosives field.

Figure 5:
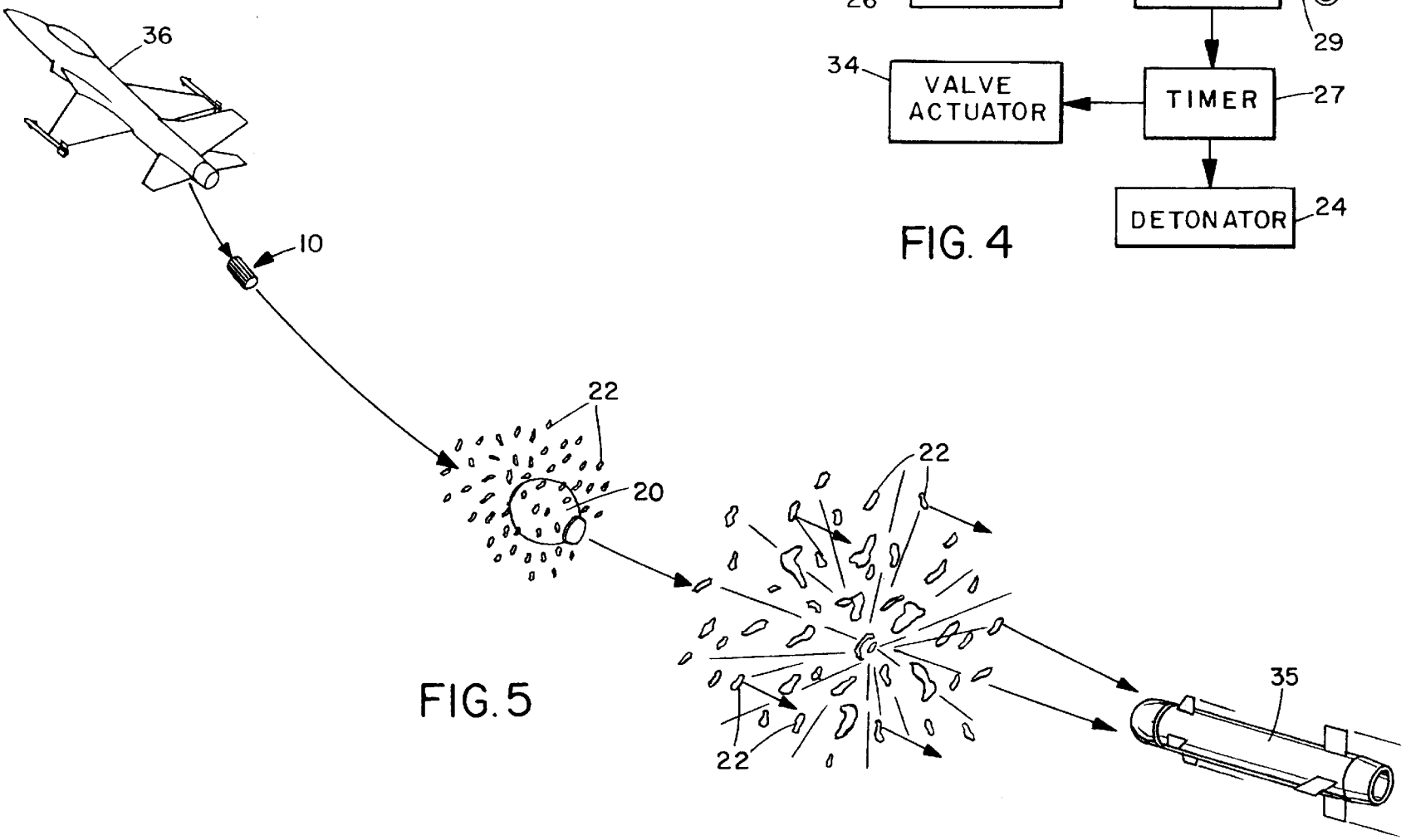
FIG. 5 illustrates the deployment of the device from an aircraft to counteract an approaching missile.

FIG. 5 illustrates operation of the decoy device 10 as a countermeasure against a seeker missile 35 which is locked onto an aircraft 36. The device is launched from the dispenser tube 12 in the path of missile 35, simultaneously pulling arming pin 29 to close switch 28. After a predetermined short time period set by timer 27, valve 33 is opened to open outlet 31, allowing pressurized noble gas to escape into the balloon 20. The balloon will be inflated by the gas into the expanded position illustrated in FIG. 3, in which the balloon confines the gas to surround the explosive charge. After release of the gas into the balloon 20, the detonator 24 is actuated to detonate the explosive charge 14. The propagation of an explosive shock wave through the confined gas causes adiabatic heating and compression of the gas. This heats the gas to temperatures in the 20,000 degree Kelvin regime and causes the gas to generate an intense flash of light containing virtually all wavelengths, which will be transmitted through the transparent material of the balloon and end pieces before the balloon is exploded and the gas dissipates into the atmosphere. Thus a short, very intense pulse of light is produced at energy levels which have been shown to damage both infra red and multi-color optical systems.

The explosively driven light source produces energy over the entire spectrum from ultraviolet to infrared frequencies, at levels several orders of magnitude greater than that of a conventional flare countermeasure. At the same time, standard pyrotechnic flares burn over a longer time period than the explosively driven source of this invention. Thus, the conventional flare typically produces light for a time period from milliseconds to seconds in length, allowing missile designers to build in their own countermeasures allowing the missile to ignore most existing flare countermeasures. In contrast, the much higher intensity light pulse produced by the present device is very short, of the order of tens of microseconds. Since this pulse is short, most countermeasures built into missiles will not have time to work, and the optical seeker system should be at least temporarily blinded, causing it to loose lock on the targeted heat source and giving the aircraft a chance to change course and escape, as illustrated in FIG. 5.

Figure 3:
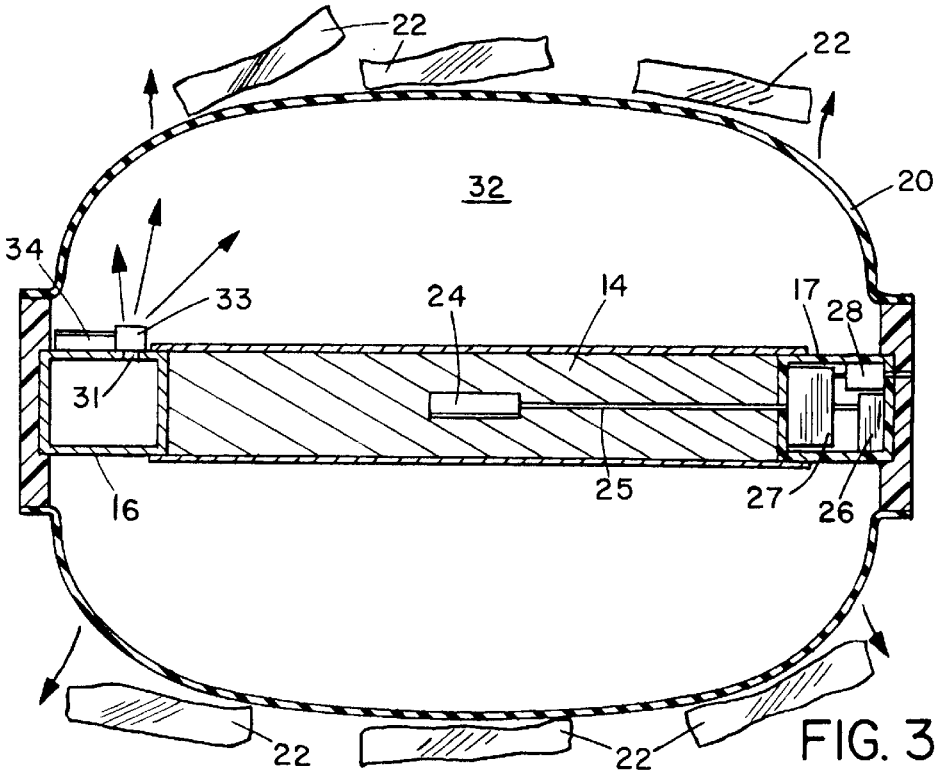
FIG. 3 is a view similar to FIG. 1, with the balloon inflated.

The reflective strips 22 loosely held between folds of the unexpanded balloon will be dispersed into a cloud around the device as the balloon expands, as illustrated in FIGS. 3 and 5. The strips are preferably reflective on both faces. When the charge is exploded, the strips will form a cloud between the aircraft and the resultant light source, as illustrated in FIG. 5, reflecting light transmitted towards the aircraft back towards the missile. Thus, upon detonation of the high explosive, and heating of the surrounding gas, light will be transmitted both directly towards the missile and indirectly by reflection from the cloud of Mylar strips 22, providing a very intense flash of light. Since the strips 22 are dispersed prior to detonation, they will have the added advantage of reducing light transmitted back towards the aircraft.

The decoy device or countermeasure of this invention will therefore act to prevent, either temporarily or permanently, an electro-optical seeker system of a missile from adequately tracking a target and guiding a missile to intercept the target. In testing, the device disrupted a missile seeker which was locked onto a black body simulating a jet exhaust 22 out of 29 times. It therefore provides an improved countermeasure which is more effective against modern seeker missiles than the conventional pyrotechnic flares currently used.

Although a preferred embodiment of the invention has been described above by way of example only, it will be understood by those skilled in the field that modifications may be made to the disclosed embodiment without departing from the scope of the invention, which is defined by the appended claims.

We claim:

1. A countermeasure device for negating an electro-optical seeker device, comprising:

an explosive charge;

a transparent container surrounding the charge for containing a noble gas;

detonator means for detonating the explosive charge to heat the gas so that it emits an intense flash of light;

an enclosure containing a supply of noble gas inside the container, the gas supply having release means for releasing gas into the container to surround the charge prior to detonation of the charge;

the container comprising an expandable balloon which is in a deflated condition prior to release of gas from said gas supply; and said gas supply comprising means for inflating said balloon into an expanded balloon filled with noble gas prior to detonation of the charge.

2. A countermeasure device for negating an electro-optical seeker device, comprising:

an explosive charge, said explosive charge comprising a generally cylindrical billet;

a transparent container surrounding the charge for containing a noble gas;

detonator means for detonating the explosive charge to heat the gas so that it emits an intense flash of light;

an enclosure containing a supply of noble gas inside the container, the gas supply having release means for releasing gas into the container to surround the charge prior to detonation of the charge; and said gas supply enclosure comprising at least one bottle containing noble gas under pressure secured to one end of said billet.

3. The device as claimed in claim 1, including a plurality of strips of reflective material releasably held on the outside of said balloon in its deflated condition, said reflective strips being released on expansion of the balloon into its expanded condition.

* * * * *